US009033855B2

(12) United States Patent
Opfer

(10) Patent No.: US 9,033,855 B2
(45) Date of Patent: May 19, 2015

(54) ATHLETIC SPEED TRAINING DEVICE USING BIOFEEDBACK

(76) Inventor: John D. Opfer, Williamsville, NY (US)

( * ) Notice: Subject to any disclaimer, the term of this patent is extended or adjusted under 35 U.S.C. 154(b) by 195 days.

(21) Appl. No.: 13/534,813

(22) Filed: Jun. 27, 2012

(65) Prior Publication Data

US 2014/0005014 A1 Jan. 2, 2014

(51) Int. Cl.

| | |
|---|---|
| ***A63B 21/02*** | (2006.01) |
| ***A63B 71/00*** | (2006.01) |
| ***A63B 21/00*** | (2006.01) |
| ***A63B 23/04*** | (2006.01) |
| *A63B 71/06* | (2006.01) |

(52) U.S. Cl.

CPC ..... *A63B 21/028* (2013.01); *A63B 21/1423* (2013.01); *A63B 21/1449* (2013.01); *A63B 23/0494* (2013.01); *A63B 2071/0655* (2013.01); *A63B 2209/08* (2013.01); *A63B 2209/10* (2013.01)

(58) Field of Classification Search

USPC ..... 482/44, 49, 51, 74, 92, 121–124, 129

See application file for complete search history.

(56) References Cited

U.S. PATENT DOCUMENTS

| | | | | | |
|---|---|---|---|---|---|
| 2,498,006 | A | * | 2/1950 | Ridill | 473/217 |
| 3,659,846 | A | * | 5/1972 | Kanicki | 482/129 |
| 3,889,684 | A | * | 6/1975 | Lebold | 607/109 |
| 4,273,328 | A | * | 6/1981 | Ozbey et al. | 482/124 |
| 4,606,542 | A | * | 8/1986 | Segal | 482/124 |
| 4,815,731 | A | * | 3/1989 | Suarez et al. | 482/124 |
| 5,013,037 | A | * | 5/1991 | Stermer | 482/122 |
| 5,167,601 | A | * | 12/1992 | Frappier | 482/121 |
| 5,203,754 | A | * | 4/1993 | Maclean | 482/124 |
| 5,205,803 | A | * | 4/1993 | Zemitis | 482/121 |
| 5,230,682 | A | * | 7/1993 | Myers | 482/122 |
| 5,282,615 | A | * | 2/1994 | Green et al. | 473/418 |
| 5,282,777 | A | * | 2/1994 | Myers | 482/122 |
| 5,497,733 | A | * | 3/1996 | Hull et al. | 119/793 |
| 5,518,480 | A | * | 5/1996 | Frappier | 482/124 |
| 5,573,487 | A | * | 11/1996 | Wallner | 482/124 |
| 5,620,186 | A | * | 4/1997 | Dudley | 473/423 |
| 5,735,776 | A | * | 4/1998 | Swezey et al. | 482/91 |
| 5,961,406 | A | * | 10/1999 | Hass | 473/576 |
| 5,980,436 | A | * | 11/1999 | Cheng | 482/124 |
| 5,993,362 | A | * | 11/1999 | Ghobadi | 482/124 |
| 6,361,448 | B1 | * | 3/2002 | McKeon | 473/207 |
| 6,652,421 | B1 | * | 11/2003 | Chen | 482/49 |
| D494,233 | S | * | 8/2004 | Kerry | D21/662 |
| 7,172,522 | B1 | * | 2/2007 | Harvey | 473/450 |
| 2003/0022769 | A1 | * | 1/2003 | Behman | 482/124 |
| 2006/0035751 | A1 | * | 2/2006 | Blair et al. | 482/49 |

(Continued)

*Primary Examiner* — Stephen Crow
*Assistant Examiner* — Garrett Atkinson
(74) *Attorney, Agent, or Firm* — Woods Oviatt Gilman LLP; Katherine H. McGuire, Esq.; Douglas R. Smith, Esq.

(57) ABSTRACT

An athletic training device, comprising a resilient member adapted to be worn behind a knee of a leg with at least one strap coupled to the resilient member so that the resilient member is located behind the knee. Two straps may be used where the first strap is coupled to the resilient member and securable to the leg above the knee; and the second strap coupled proximate to the first strap and securable to the leg below the knee. The strap or straps of the athletic training device are constructed of resilient flexible elastomeric material. Alternatively or additionally, the straps may be adjustable and held fast about the leg by one or more of the following: hook and loop fastener material, clips, snaps, buttons, and buckles.

3 Claims, 3 Drawing Sheets

(56) References Cited

U.S. PATENT DOCUMENTS

| | | | | |
|---|---|---|---|---|
| 2007/0066457 | A1* | 3/2007 | Abranchess | 482/121 |
| 2007/0135242 | A1* | 6/2007 | Schoonover | 473/458 |
| 2008/0214330 | A1* | 9/2008 | Goebel | 473/438 |
| 2010/0285936 | A1* | 11/2010 | Tacker et al. | 482/105 |
| 2011/0111930 | A1* | 5/2011 | Byrd et al. | 482/121 |
| 2011/0111931 | A1* | 5/2011 | Prstojevich et al. | 482/124 |
| 2012/0184418 | A1* | 7/2012 | Wilson | 482/112 |
| 2013/0231227 | A1* | 9/2013 | Ranieri | 482/124 |

* cited by examiner

ATHLETIC SPEED TRAINING DEVICE USING BIOFEEDBACK

FIELD OF THE INVENTION

The present invention relates to a device and method for training athletes; in particular, the device is directed to speed training and includes a resilient member adapted to be worn behind a knee of a leg. At least one strap is coupled to the resilient member and is securable to the leg. Alternatively two straps can be used where the first strap is couple to the resilient member and is securable to the leg above the knee while a second strap is coupled alongside the first strap and is securable to the leg below the knee. The strap or straps of the athletic training device are constructed of resilient flexible elastomeric material. Alternatively or additionally, the straps are adjustable and held fast about the leg by one or more of the following: hook and loop fastener material, clips, snaps, buttons, magnets, and buckles.

BACKGROUND OF THE INVENTION

Athletic training generally focuses on strength development. Whether this is in the weight room or at home, many athletes bulk up on muscle in an attempt to gain a competitive edge against their opponents. Strength training using free weights such as bars, barbells, dumbbells, and kettle bells generates muscle mass through repeated lifted of weight. Free weight exercises, however, require proper form, and often an additional exerciser to function as a spotter, to prevent bodily injury. As the body must maintain and control all of the additional weight, strain is placed on the joints of the body. Improper form can damage those joints leading to injury. Additionally, muscle fatigue during exercise may cause a lifter to slip or drop the weight. This weight can impact the body causing severe injury such as broken bones, or even death.

A number of weight machines have been developed to simulate the movements conducted during free weight training with the benefit of having the machine promote proper form and aid in preventing injuries from dropped weights. However, weight machines control movement of the weight which allows users to favor certain muscles over others. For instance, when conducting a squat press using a weight machine, a lifter can rely upon a dominant muscle group (e.g. the right quadriceps) to perform more of the lifting than other muscle groups (e.g. the left quadriceps). Thus, while a lifter may perform the squat using proper form, the lifter is developing more muscle in one area to the detriment of another. This imbalance may lead to injury during sports activity as the understrength muscles may not be able to handle the demands placed on those muscles during activity. For instance, using the example from above, an athlete such as a track sprinter uses the quadriceps to generate power while running. The imbalance between the muscles of the left leg and right leg require the left leg to work harder during the sprinting activity. If too much demand is made upon the muscles of the left leg, those muscles could pull or tear leading to injury.

Beyond an athletic facility or fitness club, a number of devices have developed for home use. Again, many of these devices are geared toward strength building, with many focusing on weight loss through strength building. One class of home use equipment includes machines designed to emulate the high-end machines of a fitness center while maintaining affordability for purchase by a home user. Thus, these machines suffer the same, if not additional, drawbacks as their gym-quality counterparts. A second class of home use equipment is designed to target specific muscle groups and is often marketed as being compact and portable. A number of these devices use springs or elastic bands to generate resistance. Thus, the home user either pulls or pushes the device to target a specific muscle group. While these devices may promote weight loss and muscle strength gains, they do not teach form or technique for optimal sports performance.

To move beyond simple strength building, training programs have been developed which improve flexibility, agility, and/or speed. These training programs generally employ training aids which target the muscles or movements used during a particular activity. By way of example, runners, and sprinters in particular, utilize a parachute device to generate resistance when running. The parachute opens behind the runner thereby forcing a runner to quicken the pace of leg movement and/or develop stronger leg muscles to "pull" the parachute. While instigating a trainee to develop quicker foot speed, runners frequently shorten their stride so that they can impart more power to the ground with each push of the foot. Thus, proper form or technique is not developed using a parachute. While a trainee may be improving running time required to complete a training task, that trainee may be developing incorrect habits leading to inefficiency and early fatigue.

A further example of a quickness training device includes a rope grid or tire run. In either of these training tools, a line of two rows of obstacles is created which requires a trainee to lift one foot over a rope or tire and place it in the next successive opening. The trainee must alternate feet as he or she moves along the course. The rope grid or tire run requires the trainee to quickly lift one foot and controllably replace that foot on the ground at a desired location (in the next successive grid opening or tire). Foot speed is improved as the trainee repeats the course trying to shorten the time required to complete the course. While the rope grid or tire run focuses on improving foot speed, these courses do not teach proper running form. Indeed, many trainees focus solely on finishing the course as quickly as possible without any regard to the form used to arrive at the finish. As a result, not only is proper form not stressed, but poor form is encouraged. Furthermore, the openings within these obstacles are generally spaced close together thereby preventing trainees from generating a full stride. Rather the trainees lift the knees generally straight up and down with very little forward travel. Thus, it can be seen that there is a need for an athletic training device that focuses on generating foot speed while also instilling proper form and full stride length.

Additionally, systems have been created to aid in developing muscle memory to teach proper form. With a specific focus on systems designed to generate muscle memory for the legs, these systems often include straps to restrict movement and force the knee to remain flexed at a specific angle depending on the activity and the desired muscle memory. A number of devices have been developed focusing on improving a golfer's swing by training the golfer to maintain a proper knee bend through the course of a stroke. The devices often utilize straps wrapped along the thigh and calf or ankle of the golfer with an additional strap or connector joining the two straps wrapped around respective parts of the leg. The joining strap is then adjusted to create an optimal flexion angle of the knee. The golfer then practices a number of golf strokes wearing the device in an attempt to generate muscle memory as to the degree of knee flexion. While these devices may help one's golf game, these devices do not aid athletes in developing proper running form. Indeed, these devices inhibit movement and are meant to be used in a stationary manner.

As such, there is a need for a device and method that encourages development of proper muscle memory while also allowing for full range of motion to maximize stride length and stride frequency. Additionally, there is a need for a device and method that provides for the development of proper muscle memory over a full range of motion while also improving strength and conditioning. The present invention addresses these and other needs.

BRIEF SUMMARY OF THE INVENTION

In general, the present invention is directed to a device and method for training athletes in proper form, as well as developing muscle memory during training exercises. The present invention addresses the above-referenced limitations presented by prior art training systems, by providing for muscle memory training over full range of motion exercises requiring a trainee to use proper form, while also improving muscle strength and aerobic conditioning. These and other features of the present invention will be described in more detail below.

One aspect of the present invention is directed to a device and method for training athletes proper form as well as developing muscle memory during training exercises, such as running drills, through use of a resilient member adapted to be worn behind a knee of a leg. At least one strap is coupled to the resilient member and is securable to the leg. Alternatively two straps can be used where the first strap is couple to the resilient member and is securable to the leg above the knee while a second strap is coupled alongside the first strap and is securable to the leg below the knee. The first and second straps of the athletic training device may each be constructed of resilient flexible elastomeric material. Alternatively, the first and second straps may be adjustable and held fast about the leg by one or more of the following: hook and loop fastener material, clips, snaps, buttons, magnets, or buckles. In an additional embodiment, the resilient member is detachable from the straps thereby obviating the need for a trainee to postpone a training session to remove the member by pulling the straps down around the foot. Through a biofeedback response generated by the training device, the athletic training device conditions a trainee to hold the ankle, knee and hip at their proper respective positions throughout a full range of motion. Thus, the foot strikes the ground with the proper shin angle so that a reactive force is applied back through the ankle, knee and hip thereby propelling the athlete forward.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
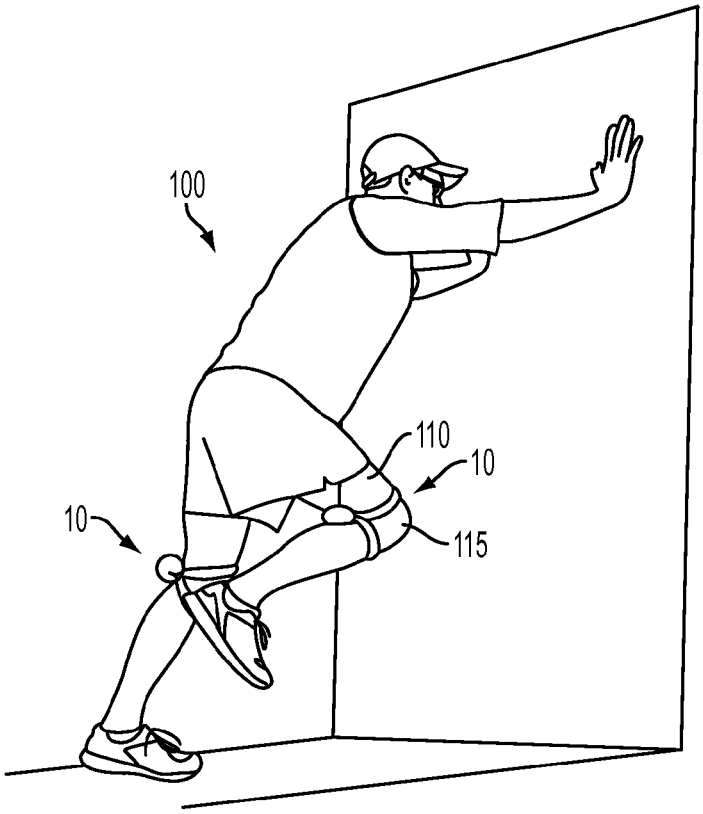
FIG. 1 is an environmental view showing an embodiment of a training device of the present invention being worn by an individual during athletic training.
Figure 2:
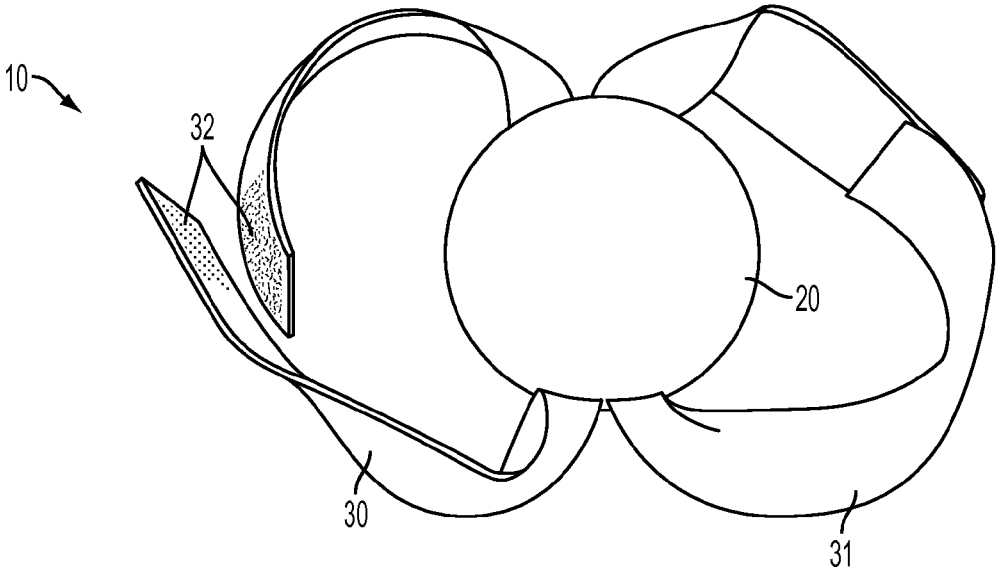
FIG. 2 is an exemplary representation of an embodiment of a training device of the present invention.

Referring to the drawings in detail, and specifically to FIGS. 1 and 2, reference numeral 10 generally designates an athletic training device in accordance with one embodiment of the present invention. In general, athletic training device 10 is comprised of resilient member 20 and a pair of straps 30 and 31. As shown in FIG. 1, during training, training device 10 is secured to leg 110 of athlete 100 with one of the straps positioned above knee 115 and the other strap positioned below knee 115. Thus, when athlete 100 bends knee 155, the back sides of the thigh and calf impact resilient member 20. Resilient member 20 stimulates a biofeedback response indicating to the athlete that the proper degree of knee flexion has been achieved. Through a biofeedback response generated by the training device, the athletic training device conditions a trainee to hold the ankle, knee and hip at their proper respective positions throughout a full range of motion. Thus, the foot strikes the ground with the proper shin angle so that a reactive force is applied back through the ankle, knee and hip thereby propelling the athlete forward. If the thigh and calf do not impact resilient member 20, the proper degree of knee flexion is not reached thereby informing the athlete that the next flexion will need to be greater in order to receive proper biofeedback. Under flexion of the knee, while not necessarily leading to injury, results in inefficient energy expenditure and competitive disadvantage. Resilient member 20 is further sized so that over-flexion of the knee is not encouraged. Over flexion of the knee can cause injury, and perhaps more important during training, teaches improper form leading to wasted energy and earlier fatigue.

Figure 3:
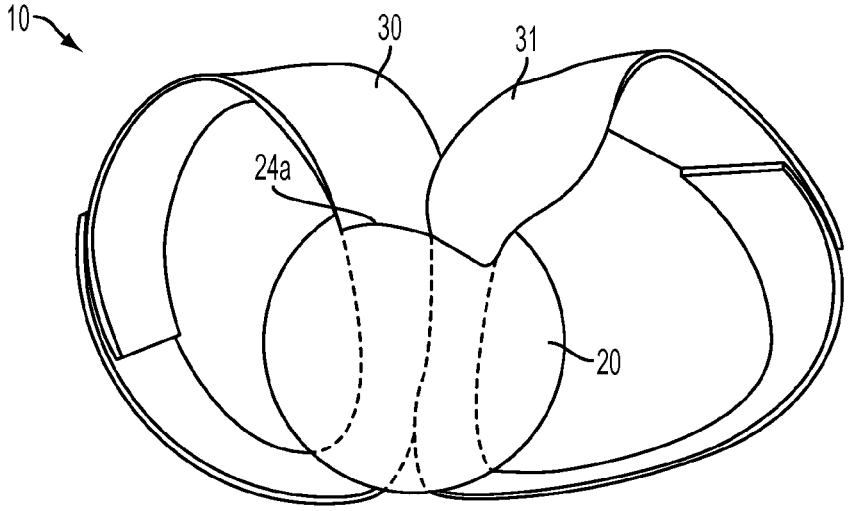
FIG. 3 is an isometric view of an exemplary representation of an embodiment of a training device of the present invention.

Adverting now to FIGS. 2 and 3, a first embodiment of athletic training device 10 comprises resilient member 20 having a pair of radially disposed slits **24*a* which first strap 30 and second strap 31 pass therethrough. While shown generally as a sphere, resilient member 20 can be constructed to take any suitable shape, such as but not limited to a sphere, an ellipsoid, a prolate spheroid, an oblate spheroid, a tri-axial ellipsoid, a cylinder, and the like. In preferred embodiments, resilient member 20 has a curved outer surface with no sharp edges which may contact the trainee. Sharp edges would irritate the contact sites on the legs when the knee is flexed and may further cause injury. A curved surface minimizes irritation while provided the desired biofeedback when contacted by the thigh and/or calf. Resilient member 20** is also preferably proportioned to rest comfortably behind the knee of a trainee while also providing biofeedback at the proper degree of knee flexion. Additionally, resilient member can be solid or hollow and constructed from any suitable material including natural rubber, a synthetic rubber polymer (such as polybutadiene, neoprene, silicone or nitrile rubber) or a combination of natural and synthetic rubber. One embodiment of a resilient member could generally be described as a solid rubber ball having a diameter roughly that of a baseball or tennis ball. An alternative embodiment has a resilient member as a hollow ball (similar to a tennis ball). In either example, the diameter of the ball is of a proper dimension to provide the requisite biofeedback during training. A solid ball provides greater mass than a hollow ball and can be further used as a strength trainer. A hollow ball allows for a moderate degree of compression when stimulating a biofeedback response and is less likely to irritate a trainee after multiple compressions between the thigh and calf muscles. The hollow form also is generally lighter weight thereby reducing trainee fatigue as compared to a solid member.

Secured to resilient member 20 are straps 30 and 31 which are used to mount the resilient member behind the knee of a trainee. In the embodiment of the training device indicated by reference numeral 10, the straps are secured to the resilient member by passing the straps through the member by way of a slit (when a solid member) or pair of slits (when hollow) disposed within the resilient member. While slit(s) 24*a* can be positioned at any suitable location on resilient member 20, in a preferred embodiment the slit(s) is/are situated proximate one edge of the resilient member. By way of example, where resilient member 20 has a generally spherical shape, slit(s) 24*a* is/are disposed at a latitude proximate one pole of the sphere. Securing straps 30 and 31 towards one edge of the resilient member increases the amount of contact between the straps and the leg thereby more securely retaining resilient member 20 in place behind the knee during rigorous activity. Straps 30 and 31 may further be secured within slit 24*a* by any suitable attachment means, such as stitching, an adhesive, a rivet, and the like. Alternatively, straps 30 and 31 can be securely mounted directly to the outer surface of resilient member 20 (with the resilient member having no slit) using one or more attachment means selected from stitching, an adhesive, a rivet, and the like. While shown and described as having two straps, it is envisioned that a single wide strap can be used to secure the resilient member behind the knee. An example is an elastic knee brace adapted to secure the resilient member in the proper location. In an alternative embodiment, a single strand of a strap is coupled to the resilient member, with the single strand bifurcating into two lobes with one lobe secured above the knee and the second lobe secured below the knee.

In one embodiment, either or both straps 30 and 31 are closed-loop straps (as illustrated by strap 31 in FIG. 2) with the two free ends of the strap stitched or otherwise permanently secured to one another. The closed-loop straps are constructed of any suitable material but are preferably constructed of an elastomeric material which will aid in slipping the straps around the foot and ankle when putting on or taking off the straps, while also allowing the straps to retract snuggly against the thigh or calf when used in training. Alternatively (as illustrated by strap 30 in FIG. 2), either or both straps 30 and 31 can be open-loop straps with the two free ends releasably attached to one another. As shown in FIG. 2, the free ends of strap 30 are releasably secured to another by fastener 32 which comprises corresponding hook-and-loop material. While shown as hook-and-loop material, fastener 32 can be any suitable fastening means including but not limited to clips, snaps, buttons, magnets, and buckles. Open-loop straps increase convenience as a trainee is not required to interrupt a training session to slip closed-loop straps over the foot when putting on or taking off the training device. Instead, the trainee can quickly mount, or remove, the device by releasably attaching, or pulling apart, the free ends of the strap. FIGS. 3 through 6 each show straps 30 and 31 is closed-looped orientation. However, it is envisioned that each of these straps may by open-looped straps as described above.

Figure 4:
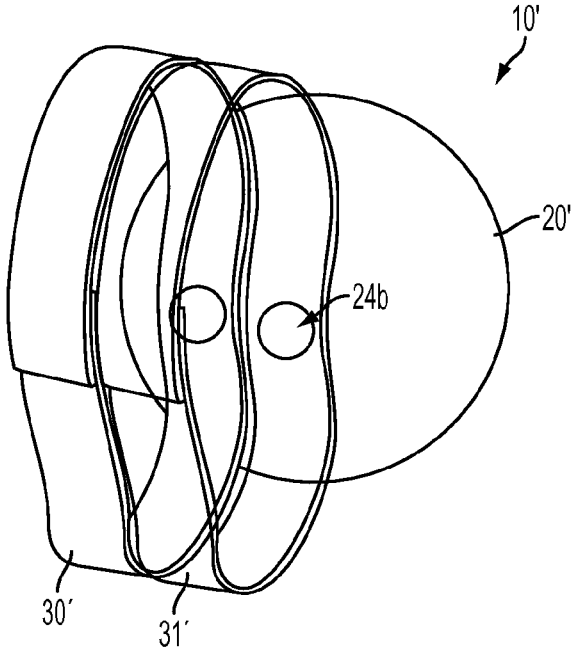
FIG. 4 is an exemplary representation of a second embodiment of a training device of the present invention.
Figure 5:
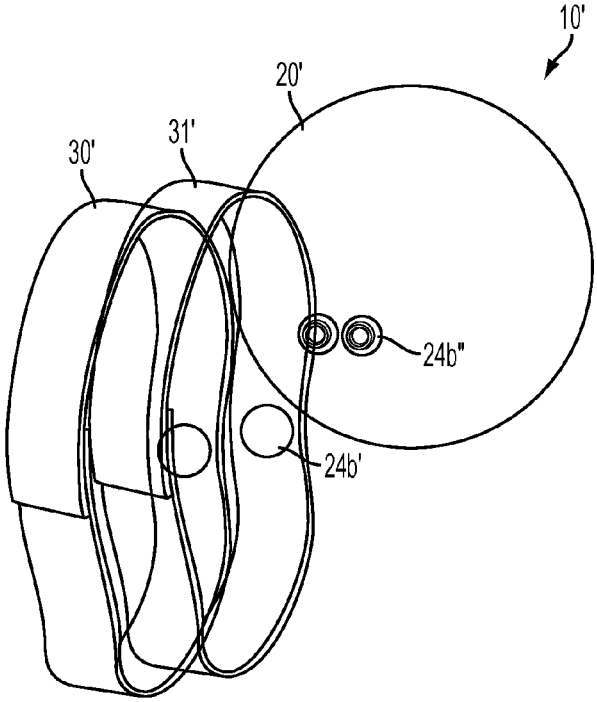
FIG. 5 shows the embodiment of FIG. 4 with the first and second straps removed from the resilient member.
Figure 6:
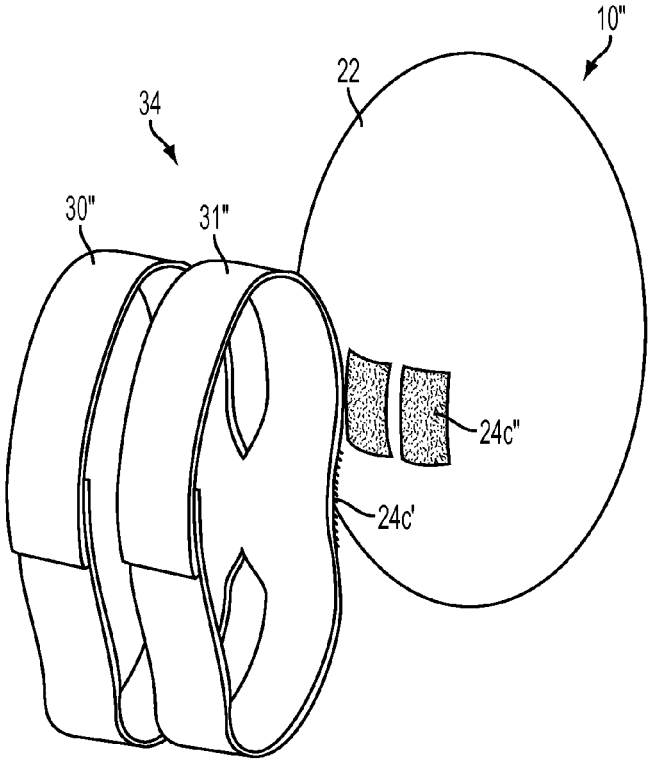
FIG. 6 is an exemplary representation of third embodiment of a training device of the present invention.

With reference to FIGS. 4 and 5, a second embodiment of a training device is generally indicated by reference numeral 10'. Training device 10' is constructed similarly to device 10 described above with reference to FIGS. 2 and 3, but has a resilient member 20' equipped with releasable strap attachment means 24*b* rather than a slit(s) 24*a*. Similarly, straps 30' and 31' are equipped with attachment means 24*b*' which correspondingly mate with means 24*b*". While 24*b*' and 24*b*" are shown as female and male snap members, respectively, it is envisioned that any suitable releasable attachment means may be used. For instance, and without limitation, releasable attachment means 24*b*' and 24*b*" can be selected from one or more of the following: hook and loop fastener material (as shown in FIG. 6), snaps, buttons, clips, threaded connections and magnets. Releasable strap attachment means 24*b* allows for uninterrupted training as an athlete can quickly attach or detach the resilient member from the straps during the training session. This is particularly convenient when straps 30' and 31' are closed-loop straps (which requires passage of the straps around the foot or ankle), or when access to straps 30' and/or 31' (whether closed-loop or open-loop) is impeded or prevented by intervening training equipment. Additionally, releasable attachment of the resilient member allows for alternative members to be used throughout a training session. For instance, weighted members may be used to teach form and encourage strength development while unweighted members teach form at "real" speed. Releasable attachment of the resilient members further enables variations in training routines to prevent athlete boredom. Additionally, resilient members of differing sizes can be switched as the trainee loses weight (thus requiring a larger diameter member to achieve the proper biofeedback response) or gains muscle mass (thus requiring a smaller diameter member) without requiring trainees to purchase or keep track of numerous devices.

Turning to FIG. 6, a third embodiment of a training device of the present invention is generally indicated by reference numeral 10". Training device 10" is constructed similarly to device 10' described above with reference to FIGS. 4 and 5, but has a non-spherical resilient member 20" equipped with releasable strap attachment means 24*c*" on resilient member 20". Resilient member 20" is generally shaped as a prolate spheroid having a minor axis with a length similar to the diameter of a tennis ball, with a slightly longer major axis. Strap 34 is a bifurcated strap having lobes 30" and 31". The non-bifurcated portion of strap 34 is equipped with corresponding attachment means 24*c*' which mates with means 24*c*". As an example of a suitable attachment means 24*c*' and 24*c*" are shown as female and male hook and loop fastener members. However, as discussed above, any suitable releasable attachment means may be used, including but not limited to hook and loop fastener material, snaps, buttons, clips, threaded connections and magnets.

While shown and described as particular embodiments, it is to be understood that the various components shown in FIGS. 2 through 6 are wholly interchangeable to produce any suitable variation of a training device comprising a resilient member and at least one strap. Examples of the various interchangeable components provide for a resilient member that can be hollow or solid, spherical or spheroidal or any other desired shape, permanently secured straps or having releasable strap attachment means; while the straps being one strap, one bifurcated strap having two lobes, or distinct two straps, and being closed-loop or open loop straps with appropriate end fasteners.

The present invention provides a number of advantages that overcome the problems and deficiencies that exist with prior art exercise training devices. For example, one advantage provided by the present invention is that the athletic device promotes training utilizing an athlete's full range of motion during a running drill. The present invention does not isolate movements to improve leg drive down (i.e. as during resistance training using, for instance, a parachute) or leg drive up (i.e. as during assistance training using, for instance, elastic bands around the thighs). Rather the present invention focuses on the entire cycle-like motion of the leg during running and improves both stride length and stride frequency. The device of the present invention provides biofeedback to the athlete thereby encouraging proper form and development of proper muscle memory.

Another advantage of the present invention is that the athletic training device is designed to fit persons of various sizes. One embodiment of the present invention provides adjustable straps for securing the device to the leg above and below the knee. The adjustable straps are proportioned so as to fit around any size leg. Adjustable straps also allow for easier application or removal of the device as an athlete is not required to sit down and slide the bands over the shoe.

In an additional embodiment, although being described as a ball or sphere, the resilient member placed behind the knee is interchangeable so that any desired shape can be used, such as an ellipsoid or prolate spheroid. Additionally, resilient members of diverse diameters or resiliencies can also be interchangeably attached to the straps. Thus, as an athlete's legs become leaner, or more muscular, the diameter of the ball can be expanded, or reduced, to accommodate for the thinner legs, or increased muscle mass, while continuing to promote the proper degree of flexion at the knee. A further advantage is that while interchangeable, the resilient member is also removable. Thus, if the straps used are not adjustable or otherwise convenient to remove during training, the resilient member can simply be detached from the straps when the member is not being utilized in training.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A method for training an athlete comprising the steps of:

a. providing a training device consisting essentially of:

i) a resilient member adapted to be worn directly against a back surface of a knee of a leg wherein said resilient member is a shape selected from one of the following: a sphere, an ellipsoid, a prolate spheroid, an oblate spheroid, a tri-axial ellipsoid, and a cylinder;

ii) a first strap coupled to said resilient member and securable to said leg above said knee; and iii) a second strap coupled to said resilient member in spaced parallel relation proximate said first strap, said second strap being securable to said leg below said knee wherein each of said first and second at least one adjustable strap is held fast about said leg by one or more of the following: hook and loop fastener material, clips, snaps, buttons, magnets, and buckles;

b. allowing said training device to be applied to at least one leg of said athlete whereby said resilient member directly contacts the back surface of said knee;

c. allowing a series of drills to be conducted wherein said knee is flexed such that said resilient member maintains direct contact with the back surface of the knee throughout the drills to thereby provide a biofeedback response to said athlete when said resilient member is contacted by a back of a thigh and a calf of said athlete.

2. A method according to claim 1, wherein a respective training device is applied to each leg.

3. A method according to claim 1, wherein said drills comprise running exercises utilizing a full range of motion of said leg.

* * * * *